US005822823A

United States Patent [19]

Polzin et al.

[11] Patent Number: 5,822,823

[45] Date of Patent: Oct. 20, 1998

[54] APPARATUS AND METHOD FOR APPLYING COATINGS TO PLANAR AND NON-PLANAR SURFACES

[75] Inventors: Bruce C. Polzin, Greendale; Kenneth L. Shehow, Milwaukee; Mark T. Sterwald, Manitowoc; William W. Barton, Greendale, all of Wis.

[73] Assignee: Newell Operating Company, Ill.

[21] Appl. No.: 514,489

[22] Filed: Aug. 11, 1995

[51] Int. Cl.[6] ..... B05C 17/00

[52] U.S. Cl. ..... 15/210.1; 15/160; 15/143.1

[58] Field of Search ..... 15/140, 143.1, 15/160, 159.1, 209.1, 210.1

[56] References Cited

U.S. PATENT DOCUMENTS

| | | | |
|---|---|---|---|
| 1,079,672 | 11/1913 | Simpson | 15/209.1 |
| 1,517,864 | 12/1924 | Runk | 15/210.1 |
| 2,156,270 | 5/1939 | Smith | 15/209.1 |
| 2,300,684 | 11/1942 | Maxfield | 15/210.1 |
| 2,961,681 | 11/1960 | Terzian | 15/209.1 |
| 3,117,334 | 1/1964 | Imhof | 15/210.1 |
| 3,414,929 | 12/1968 | Warner et al. | 15/210.1 |
| 3,638,270 | 2/1972 | Schlegel, Jr. et al. | 15/209.1 |
| 4,134,173 | 1/1979 | Cupp et al. | 15/210.1 |
| 4,829,623 | 5/1989 | Brezette et al. | 15/210.1 |
| 5,267,369 | 12/1993 | O'neil et al. | 15/210.1 |

FOREIGN PATENT DOCUMENTS

| | | | |
|---|---|---|---|
| 385649 | 5/1908 | France | 15/209.1 |
| 855154 | 5/1940 | France | 15/210.1 |
| 1181230 | 2/1970 | United Kingdom | 15/210.1 |

*Primary Examiner*—Tony Soohoo
*Attorney, Agent, or Firm*—Foley & Lardner

[57] ABSTRACT

A replaceable coating applicating pad having, as the paint applicating medium, a velour fabric with a short nap is disclosed. In one embodiment, the pad includes a winged handle and a conforming pad which is suitable for large surfaces; in a second embodiment the pad is small with sharp corners for work in confined spaces; and in a third embodiment the pad is mounted on a sponge rubber-like handle for use on curved and other non-planar surfaces. A method of coating application is also disclosed.

18 Claims, 4 Drawing Sheets

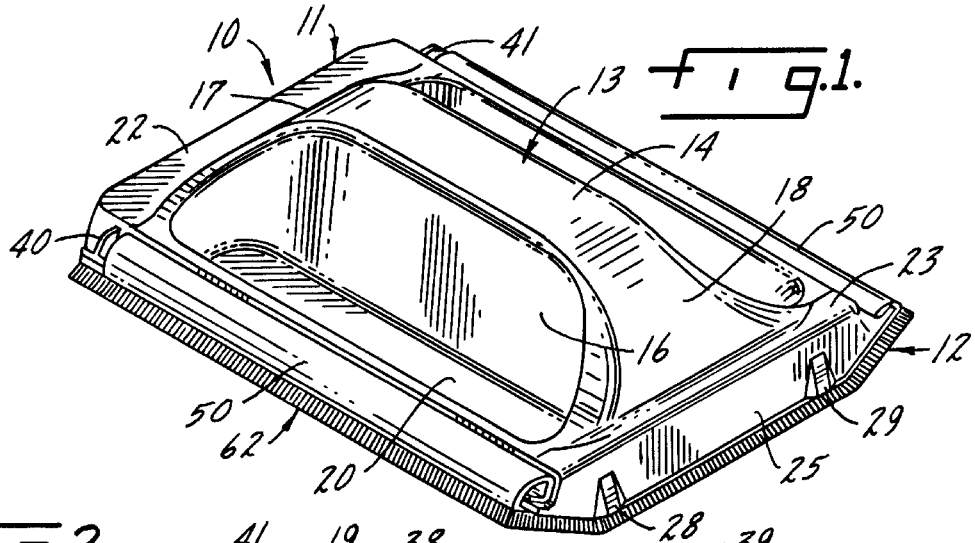
Fig. 1.
Fig. 2.
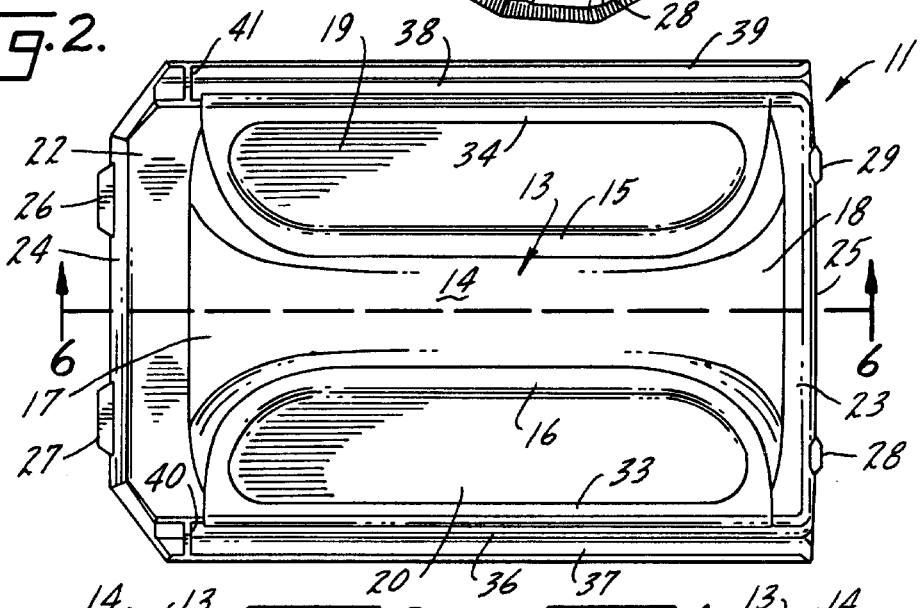
Fig. 3.
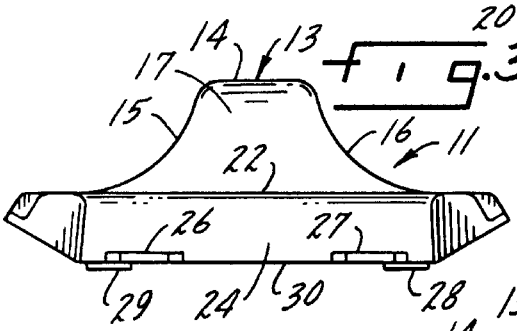
Fig. 4.
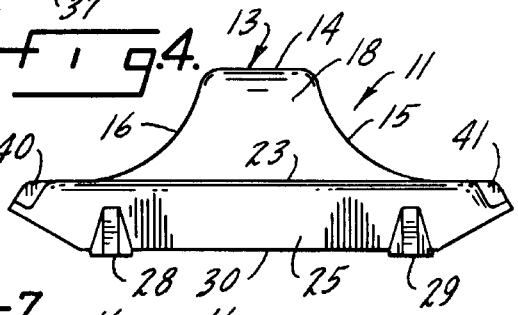
Fig. 5.
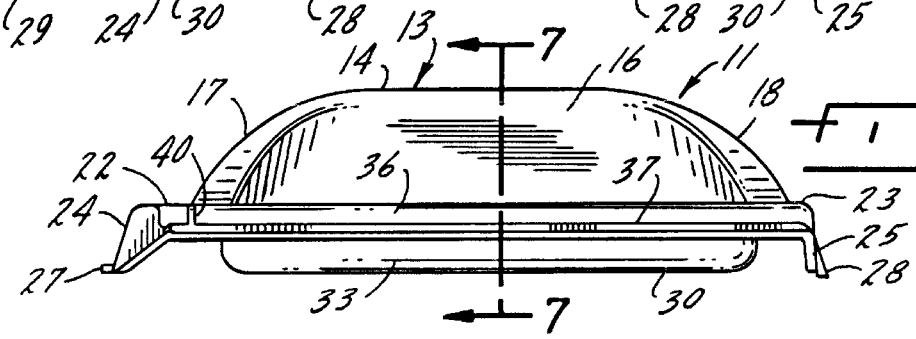

Fig. 19.
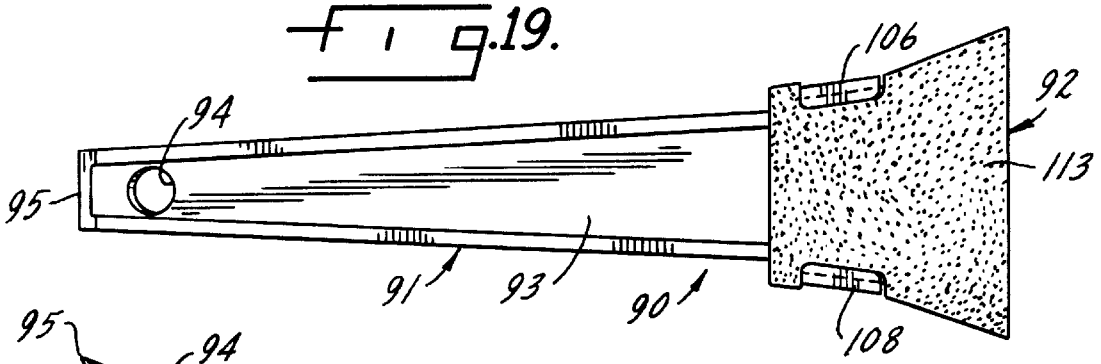
Fig. 20.
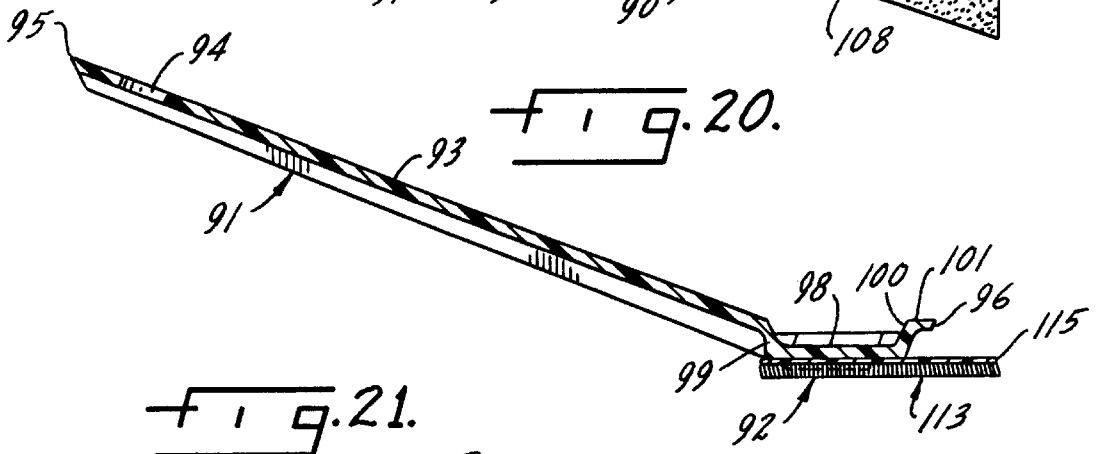
Fig. 21.
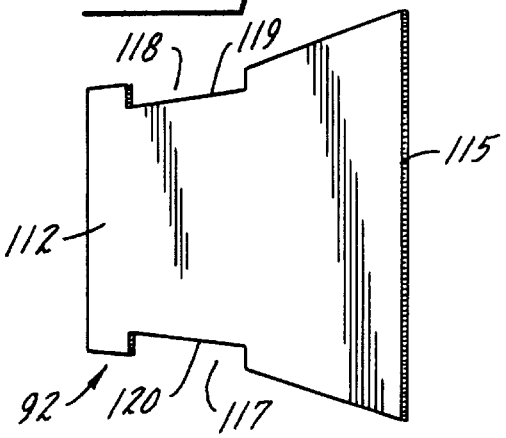
Fig. 22.
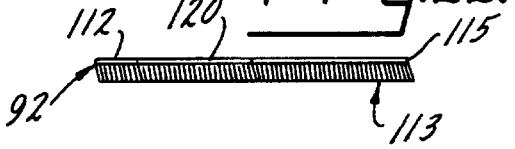
Fig. 23.
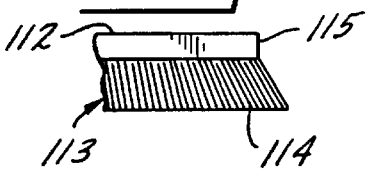
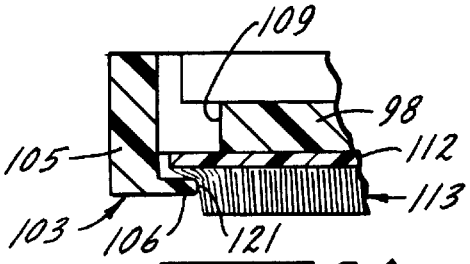
Fig. 24.

APPARATUS AND METHOD FOR APPLYING COATINGS TO PLANAR AND NON-PLANAR SURFACES

This invention relates generally to apparatus and methods for applying coatings to planar and non-planar surfaces, and specifically to pad-type applicators especially well adapted to apply thin coatings, such as stains and varnishes, to flat surfaces such as table tops, and contoured surfaces, such as chair spindles, which eliminates the use of rags or brushes and the mess and wastefulness inherent in the use of rags and brushes.

BACKGROUND OF THE INVENTION

Rags and brushes have, to the present time, been almost exclusively used for the applications of thin coatings. By "thin coatings" is meant coatings having generally lower viscosities than the viscosities characteristic of interior and exterior paints and specifically coating materials which may be described, for purposes of ready reference, as stains and varnishes.

In coating stains for example, the most commonly used procedure is to saturate a rag, or a portion of a rag, with the stain, apply the stain containing portion of the rag to the surface to be stained and thereafter wiping the just-applied stained surface with a second rag for the purposes of removing the excess and smoothing the coated layer of stain uniformly and evenly over the surface being treated so as to avoid a final blotchy or uneven appearance. An alternative method is to apply a stain with a brush, and thereafter wipe the applied stain with a rag. The purpose of the rag is, again, to wipe off excess stain just applied by the brush, and to smooth the coated layer of stain uniformly and evenly over the surface being treated to avoid a blotchy or uneven appearance. The brush-rag process is less efficacious than the two-rag system in several respects, one being that a brush may not apply the coating to a thick enough depth, particularly when a non-planar surface is being treated such as a chair spindle, due to the separation of the filaments during the application strokes. If insufficient coating is initially applied by a brush, the insufficiency usually cannot be remedied by the subsequent wipe of a rag. And a third generally inefficient method of applying stain, which is usually used only on large flat surfaces, is to flood coat the surface area to be stained with the stain and thereafter wipe up the excess with a rag or rags. Although the possibility of insufficiency application of stain may not be great in flood-coating, this process is very wasteful of stained material and exceedingly messy.

The applicator of choice for varnish is a brush, though a combination of a brush and a rag and even, in rare occasion, flood-coating has been used. The disadvantage of using a brush to apply varnish is that brush strokes are frequently seen in the final finish, particularly when the varnish has been applied by the occasional user, such as a do-it-yourself consumer who is not skilled with a brush. Loose filaments are often shed from the brush and, if not noticed and removed while the varnish is still fresh, remain as an unsightly discontinuity in an otherwise smooth surface. Lint from a rag produces a similar undesirable result, and bubbles frequently appear in the final surface. In addition, considerable effort must be made to apply varnish uniformly a task which is more difficult than application of conventional paints for example, since varnishes are almost uniformly stickier and harder to work than paint. Both foam and brush filament brushes are prone to pump air into the applied coating, thereby creating undesirable bubbles in the final surface, though foam brushes are more apt to do so than filament brushes.

In summary, all of the above-described applicators and application methods are messy and wasteful. They are messy in that the user's hands invariably come in contact with the coating and this is true even when varnish is brushed on since invariably the user must pick up a loosened filament or a piece of lint, which has come loose from the applicator during use, and alighted on the coated surface where it is not desired. Said methods are wasteful in that the rag used to apply such coatings, at the end of a coating session, are loaded with coating which is of no further use and must be thrown away along with the rag. The greater the number of small jobs separated by a time span in which the coating-filled rags are fully or partially dried, the more wasteful is the rag or foam brush application process. Further, job requirements often dictate that the operator be confined to only one type of applicator and that specific need-dictated applicator may be undesirable for reasons peculiar to the user, such as an aversion to messy operations, or cost. Brushes for example, are not generally suitable for rounded, curved surfaces, such as the spindles in a chair back or a round chair leg. Thus, the user is forced to use a flood-coating or, more likely, the rag application system with respect, particularly, to stains and varnishes.

Thus, there is an existing need for a type of applicator and method of application which is not messy, is not wasteful of coating material, which is applicable to both planar and non-planar surfaces, and which always results in a neat, smooth, uniform depth of coating.

SUMMARY OF THE INVENTION

The invention is a stain and a varnish applicator which overcomes all the operational disadvantages of currently used applicators in that it does not create a mess during or after application, is not wasteful of the stain or varnish coating material (hereafter usually referred to simply as "coating material"), is usable on all planar and non-planar surfaces, lends itself to mass production fabrication methods, and is economically competitive with, and often less expensive for the consumer than, conventional rag and brush coating systems.

Specifically, the invention includes an applicator having a velour or velvet fabric with a directional filament which has the ability to reach all surface contours and to apply, spread evenly and remove excess coating material in a single operation and which does not bring the coating into contact with the user and wastes none or only a minimum amount of the coating material.

In one embodiment, which is particularly well-adapted for large surface area application, a pad of convenient size having said directional fabric is formed with edges which are upwardly angled with respect to the surface to be coated so that the applicator may be pulled over the surface to be coated as many times as necessary without scraping off the coating already applied, and, also, to feather finishing strokes so as to remove any undesirable bubbles which may have appeared before the final stroke.

In another embodiment, which is particularly well-adapted for non-planar surfaces, such as chair back spindles, a pad having said directional fabric is formed with an interior portion which is mounted to freely flex and thereby conform to the contour of a non-planar surface with a pressure which is substantially uniform over the non-planar area so that coating can be uniformly applied, the flexing action mimicking a human hand wrapping around or along the non-planar surfaces. The foregoing is accomplished without the creation of a drainage channel within the applicator which would permit the coating to run out.

In yet another embodiment which is particularly well-adapted for small spaces, such as the surfaces of individual slats or louvers in a louver blind or window sash trimming, a pad having said directional fabric is formed with a very thin, flat contour and acute angles which results in a configuration having all of the characteristics above-mentioned and, also, the ability to apply coatings evenly and efficiently in very small spaces such as on the surfaces of individual slats or louvers or on surfaces defined by acute angles.

Other features and advantages of the invention will become apparent from the following detailed description of the invention when taken in conjunction with the foregoing.

BRIEF DESCRIPTION OF THE DRAWING

The invention is illustrated more or less diagrammatically in the accompanying drawing in which FIG. 1 is a perspective view of a large surface pad applicator;

FIG. 2 is a top, plan view of the large surface pad applicator of FIG. 1;

FIG. 3 is a left end view of the large surface pad applicator;

FIG. 4 is a right-end view of the large surface pad applicator;

FIG. 5 is a front elevation of the large surface pad applicator;

FIG. 19 is a bottom, plan view of the applicator of the third embodiment;

FIG. 20 is a section view taken substantially along the line 20—20 of FIG. 16;

FIG. 21 is a top, plan view of the pad of the third embodiment;

FIG. 22 is a side view of the pad of the third embodiment;

FIG. 23 is a detail view to an enlarged scale showing the directionality of the fabric of the pad of the third embodiment; and FIG. 24 is a section view taken substantially along the line 24—24 of FIG. 16.

DETAILED DESCRIPTION OF THE INVENTION

Figures 6, 7, 8, 9, 10, 11:
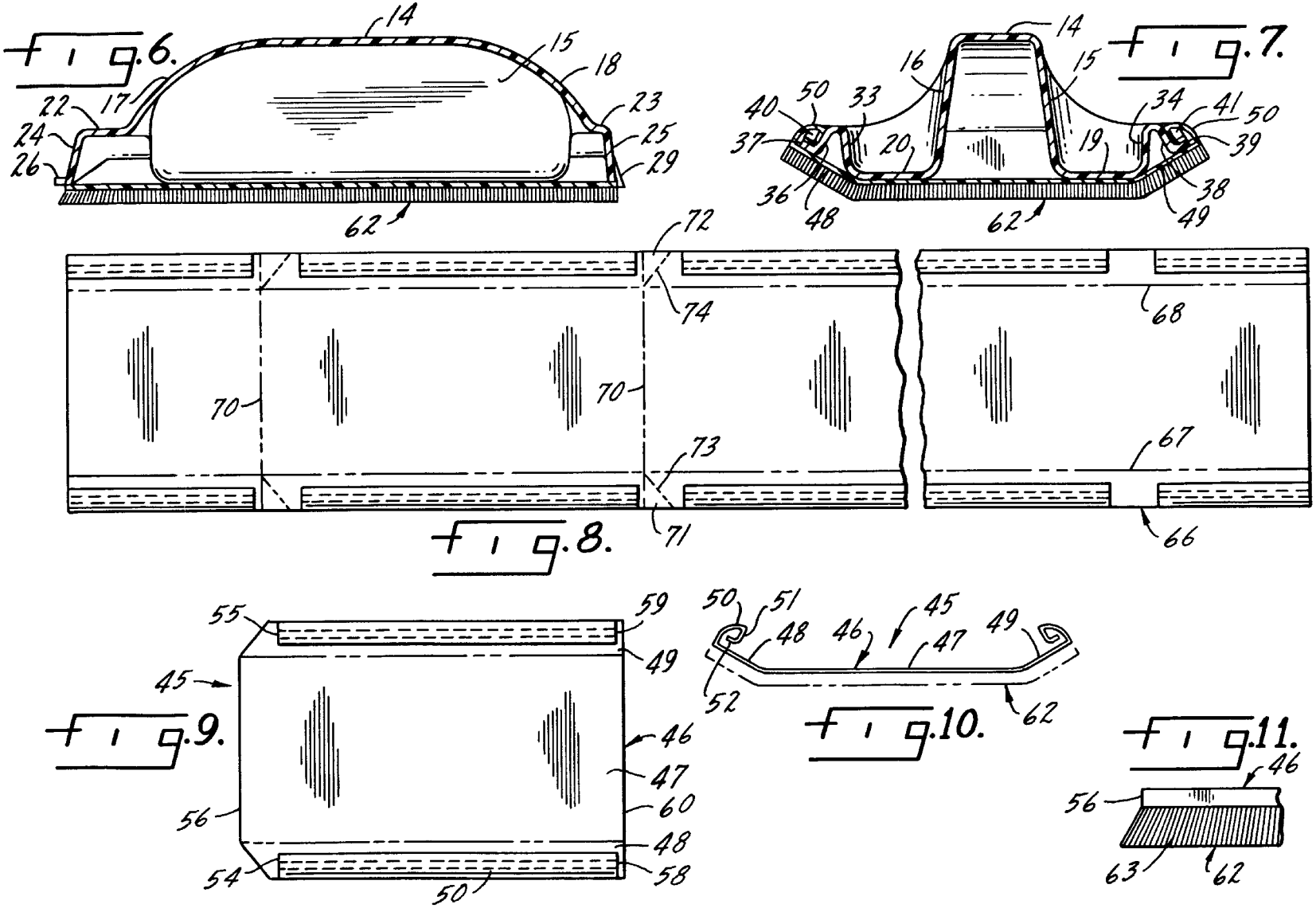
FIG. 6 is a section view taken substantially along the line 6—6 of FIG. 2.
FIG. 7 is a section view taken substantially along the line 7—7 of FIG. 5.
FIG. 8 is a top, plan view of the continuously formed pad prior to separation and trimming.
FIG. 9 is a top, plan view of a replaceable large surface pad applicator of FIG. 1.
FIG. 10 is a right-end view of the applicator pad of FIG. 9.
FIG. 11 is a detail view to an enlarged scale of the leading edge of the applicator pad of FIG. 9 illustrating the directionality of the fiber.

In the following description of the invention, like reference numerals will be used to refer to like or similar parts from Figure to Figure in the drawing.

The large surface pad applicator embodiment of the invention is indicated generally at 10 in FIG. 1. The applicator includes a handle, indicated generally at 11, to which a replacement pad, indicated generally at 12, is assembled or dis-assembled as required. The handle 11 includes is centrally located finger-grip, indicated generally at 13, having an upper wall 14 flanked by a right side wall 15 and left side wall 16, and closed by front wall 17 and rear wall 18. The side walls 17 and 18 curve outwardly at their front and rear ends, as best seen in FIGS. 1, 2, and 7, and meld into bottom sections 19 and 20. A ledge 22 is formed at the front end of the applicator and another ledge 23 is formed at the rear end thereof. A front wall is indicated at 24, and a rear wall at 25. A pair of trim guides are indicated at 26, 27, on the front wall 24. The trim guides enable a user to apply a coating to one surface and trim up to an adjacent surface in a uniform and straight line. A pair of stop dogs are indicated at 28, 29, on rear wall 25. As best seen in FIGS. 4, 5, and 6, but also in FIG. 3, the stop dogs project downwardly beneath the plane 30 of the bottom of bottom sections 19 and 20, a distance sufficient to preclude rearward sliding movement of the replaceable wear element after said wear element has been assembled to the handle, as will be described in further detail hereinafter.

The left side wall 33 extends upwardly from left bottom section 20, and right side wall 34 extends upwardly from right bottom section 19, all as best seen in FIG. 4. The upper end of left side wall 33 rises to a height at which it is substantially flush with the front ledge 22, and then bends downwardly and outwardly at 36, and terminates in outwardly extending left flange 37. In similar fashion, the upper end of right wall 34 rises to a height at which it is substantially flush with the front ledge 22 and then bends downwardly and outwardly at 38, and terminates in outwardly extending right flange 39. A left abutment wall is indicated at 40, see FIGS. 1, 2, 5, and 7, and a right abutment wall is indicated at 41.

The replacement wear element of the pad applicator, here a fabric pad, is indicated generally at 45 in FIGS. 9 and 10. Fabric pad 45 includes a solid yet flexible backing member indicated generally at 46 which includes a flat, center section 47 and left and right side sections 48 and 49 respectively, best seen in FIGS. 7 and 10, which are inclined upwardly and outwardly from the center section 47. Left side section 48 terminates in an upwardly and inwardly curved portion 50 which then extends downwardly and inwardly at 51, and finally outwardly at 52. Right pad section 49 is similarly contoured. As best seen in FIG. 9 the front ends 54, 55, of left and right side sections 48 and 49 terminate well behind the front edge 56 of center section 47. Preferably, the rear walls 58, 59 of the left and right sections 48, 49 terminate just short of rear edge 60 of center section 47.

A directional fabric indicated generally at 62 is carried by and projects downwardly from the pad backing 46. The directional fabric (hereafter usually simply called "fabric") is a velour which is a closely napped velvet like fabric in the sense that velvet is understood to mean a synthetic fabric such as rayon, having a smooth, dense pile, and a plain back. The individual filaments 63 of the fabric may and usually will have a flexible fabric backing which is secured, as by an adhesive, to the pad backing 46. Since the particular means by which the fabric is secured to the backing 46 s conventional, it is not further described. Since the backing 46 may advantageously be formed from stiff polyvinyl chloride which may be on the order of about 0.020 inches thick, it will be appreciated that the pad 45, though a nominally rigid and self-sustaining structure, may be easily flexed by hand-applied pressure to assemble and disassemble a pad 45 from the handle 11. From FIG. 6 it will be noted that, after assembly of pad 45 to handle 11, stop dogs 28 and 29 extend beneath the plane 30 of the bottom of the handle a distance sufficient to form a stop, or abutment, against which the backing 46 of pad 45 abuts, yet the stop dogs do not extend downwardly far enough to interfere with the functioning of the individual filaments 63 in fabric 62.

Several types and forms of fabric are feasible. The fabric construction can be made using a number of commercially available processes such as weaving, sliver knitting, spring needle knitting, tufting, or continuous non-woven filament construction, or even other modes. The fabric pile can be made using a variety of materials, such as Acrylic, Mod acrylic, cotton, wool, polyester, other polyolefins, nylon, rayon, mohair, and others. The fabric pile heights may vary from 0.03 inches up to 1+ inch, though the latter will be used very infrequently. The pile density can vary from light to heavy as those terms are currently understood in the art.

In the currently most preferred embodiment of the invention the velour fabric has the following characteristics:

1. Woven construction has the benefits of better uniformity in pile, the ability to use finer, softer pile fibers, and it locks the pile fibers into the backing better thereby reducing or eliminating loose fibers from coming out during use.

2. Pile materials: Acrylic fibers have the ability to be fine and soft, resistant to both water base and solvent-based coatings. The color exists throughout the fabric when it was made, resulting in a color fast fabric when exposed to various solvent systems. Some synthetics and natural fibers, like cotton, are post-dyed only on the surface and do not become color fast when exposed to some solvent systems. Some fibers such as Mod acrylic do not have solvent resistance to certain solvents such as acetone. Some fibers will change characteristics depending upon what solvent system they are exposed to such as wool which will lose its resiliency and matt down in water systems, but not in solvent systems. The coarseness of some fibers such as wool will not give as smooth a coating film as a fine fiber.

3. Pile height: A short pile will not carry as much coating material as a longer pile, but it will apply a smoother film. Preferably, a pile height of about 0.110 inches is used (including the 0.025 inches backing).

4. A relatively dense pile will allow the pad to pick up more stain or varnish which generally has a very low viscosity without running out and dripping. The higher the density, the smoother and more uniform the coating film will be. A typical density range should be on the order of about 15 to 25 ends per inch. Preferably 21 ends per inch are used.

To assemble pad 45 to the handle 11, the original manufacturer, or the do-it-yourself user if a replacement pad is desired to be installed, merely pushes the curled portion 50, 51, 52 of the pad 45 over the flange 37 at the outer edge of the handle at a location such that the front ends 54, 55 of the curled portions 50, 51, 52, will lie just behind abutment walls 40 and 41 at the outside edge portions of handle 11. After assembly, the abutment walls 40, 41 will preclude movement of pad 46 in a forward direction relative to the handle 11, and they align the directional filaments of the fabric with the trim guides 26, 27 on the front of the handle. The stop dogs 28, 29 will preclude movement of pad 46 in a rearward direction relative to handle 11.

It will be noted that the handle 11 has a smooth contour and no undercuts. These features combined with its one piece design makes feasible mass production methods, and hence, low cost manufacture of the handle which can conveniently be done by injection molding.

The pad 45 is also extremely well-adapted for mass production techniques. By reference to FIG. 8 it will be seen that pad 45 is preferably made in a continuous strip indicated generally at 66. Score lines are indicated at 67, 68, said score lines marking the junctions between center section 47 and side sections 48, 49 of the pad. Cut-off lines are indicated at 70, the rear edge 60 of one pad being formed on a preceding pad and the front edge 66 of a trailing pad being formed as the continuous strip is cut along line 70. Here, triangular sections 71, 72 are cut off as waste when the continuous strip is cut off at 70 by side cuts at 73, 74. It will be noted that the front corners of handle 11 are formed with cutback corners, see FIG. 2, and thus, the final shape of pad 45 will conform to the front outline of the handle. The cutback corners of the front edge of the handle and pad allow the user to coat a surface while trimming next to an adjacent surface and not wiping the coating on the adjacent surface.

It is essential however, that, for proper functioning, the pad, and hence the velour, always be so oriented that the working ends of the individual filaments always project forwardly from the nominal or front end of the applicator. Referring to FIG. 11 for example, the filaments are so arranged as to project forwardly ahead of the front edge 56 of the center section.

The upwardly inclined side sections 48, 49 of the pad, and the complementary configuration of side wall structures, 33, 36, 37 of the handle 11, allow the pad during use to be pulled over the wood surface repeatedly without scraping the coating already applied off, much like the curled-up end of a toboggan rides up and over snow. The configuration also allows the user to roll the pad during the finishing stroke to feather off the stroke thereby eliminating any undesirable bubbles. The trim guides on the front edge of the handle permit the user to apply a stain or varnish to one surface and trim up to an adjacent surface in a uniform and straight line.

An alternative embodiment of the invention is demonstrated in FIGS. 12–15, this embodiment being especially well adapted to apply coating to non-planar surfaces, and particularly round surfaces such as, for example, the spindles in a chair back. It will be understood however, that the embodiment will also trim acceptably on flat surfaces so that, for example, a user who desires to coat an object such as a chair having round surfaces such as spindles, and flat surfaces such as a seat, need not change applicators to work from one coating-receiving surface to another.

The non-planar applicators, which for ease of reference will hereafter be referred to as a spindle pad, is indicated generally at 75. The spindle pad includes a handle, indicated generally at 76, and a fabric pad, indicated generally at 77. In this instance, the fabric pad 77 is preferably integrally formed with the handle.

Figure 12:
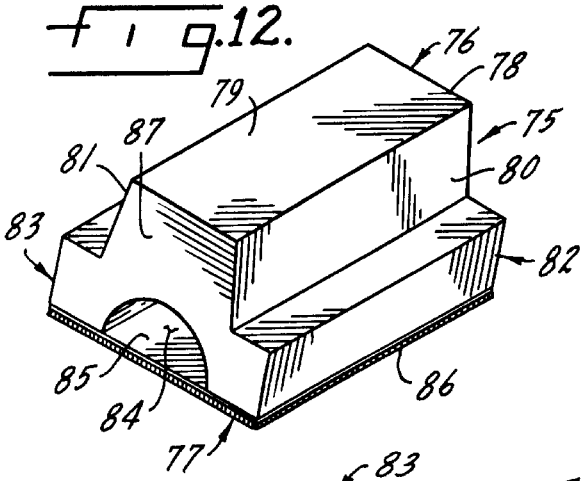
FIG. 12 is a perspective view of a second embodiment of the invention especially adapted for coating application to non-planar surfaces.
Figure 13:
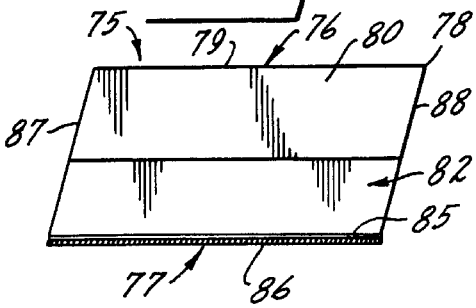
FIG. 13 is a side elevation view of the applicator of FIG. 12.
Figure 14:
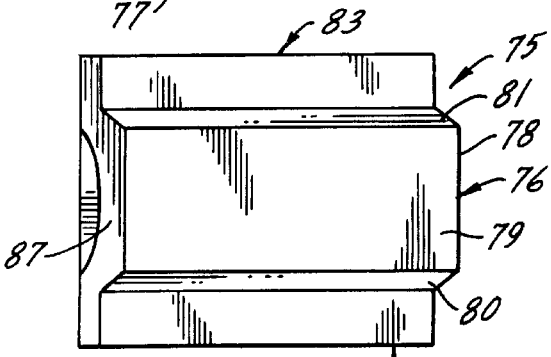
FIG. 14 is a top, plan view of the applicator of FIG. 12.
Figure 15:
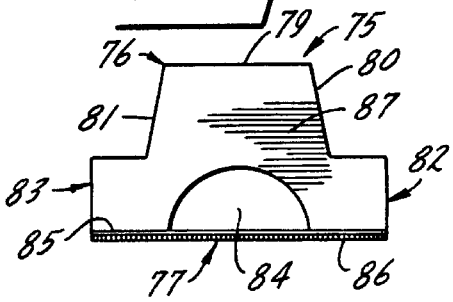
FIG. 15 is an end view of the applicator of FIG. 12.
Figure 16:
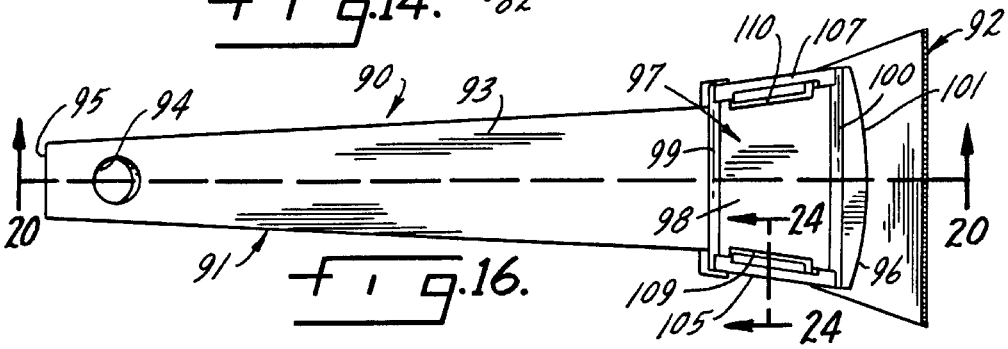
FIG. 16 is a top, plan view of a third embodiment of the invention especially adapted for small, relatively inaccessible areas and acute angled junctions.

The handle 76 has an upwardly projecting hand-grip 78 which includes a top 79, a left side wall 80, and a right side wall 81. A left wing or extension which is integral with handle 76 is indicated generally at 82, and a similar right wing is indicated generally at 83. The bottom surfaces of left and right extensions, 82, 83, lie in a common plane as best seen in FIGS. 13 and 15. Hand-grip 78 does not extend downwardly so as to lie in the plane of the bottoms of extensions 82 and 83, as best seen in FIGS. 12 and 15. Rather, a void 84 is formed beneath the upper portion of hand-grip 78 and between the extensions 82 and 83 so that a configuration resembling a yoke is formed. The material from which the handle is formed is deformable and preferably it is soft, compressible and resilient; it may have the characteristics of sponge rubber. A suitable material is 2 pound cross-link polyethylene, bun cast.

The fabric pad 77 is similar in material and structure to the pad 45 of the embodiment of FIGS. 1–11. Thus, the fabric pad 77 includes a stiff, yet bendable backing 85 which carries a fabric 86 composed of individual filaments. It will be noted that in this embodiment the front corners of the pad 77 are not cut back, the pad thereby having a rectangular outline which coincides with the outline of the handle 76. However, except for this structural difference, the material of fabric pad 77, including the fabric which consists of the backing 85 and filament 86, is preferably identical to the corresponding elements of the embodiment of FIGS. 1–11.

In use on the exterior surface of a round object, the fabric pad 77, after being loaded with coating, is placed against to the object to be coated, and gentle hand pressure applied to the sides and wings, and particularly the wings, to cause the pad 77 to wrap around said object in snug, substantially even pressure engagement therewith. No sharp trough is formed which would permit coating carried by the directional fabric 86 to run out of the pad 75. A user then merely slides the pad up, down and around the spindle to apply coating evenly at all locations.

By the same token, if it is desired to apply a coating to a depression or a trough area, the user need merely squeeze the left and right side walls 80, 81, and the fabric pad 77 will assume a convex configuration which will tend to adapt to the configuration of the trough area, such as would be found in crown molding. The angled front 87 and angled back 88 of the handle 76 allows the user to use the front edge of the pad to get into tight, hard-to-reach places such as grooves on a spindle.

A further embodiment of the invention is shown in FIGS. 16–24, this embodiment being especially well-adapted to apply to coating in tight areas such as louvers or awkward areas such as window sash where a brush or rag either cannot effectively reach, or can only do so with considerable difficulty. It will be understood however, that this embodiment will also function on flat surfaces of a size which can be suitably treated by either of the previously described embodiments. However, the coating efficiency of the embodiment of FIGS. 16–24 will be considerably lower than the coating efficiency of the earlier embodiments in view of the generally smaller size of the applicator and the lack of inclined edges for feathering.

This embodiment, which for convenience of reference will be referred to as a louver pad, is indicated generally at 90. The louver pad 90 includes a handle indicated generally at 91 and a fabric pad indicated generally at 92; see particularly FIG. 21.

Handle 91 includes a shank 93 which may have an aperture 94 at its tail or proximal end 95 for purposes of display at the point of sale. In this instance the shank 93 tapers outwardly toward the distal end 96 and it may have a contoured surface to facilitate grasping in the hands of the user, such surface being a series of projections, knurling, grooves, etc.

Figure 18:
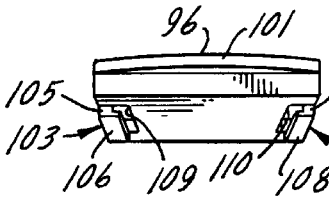
FIG. 18 is a view taken substantially along the line 18—18 with the pad removed and with portions omitted for clarity.
Figure 17:
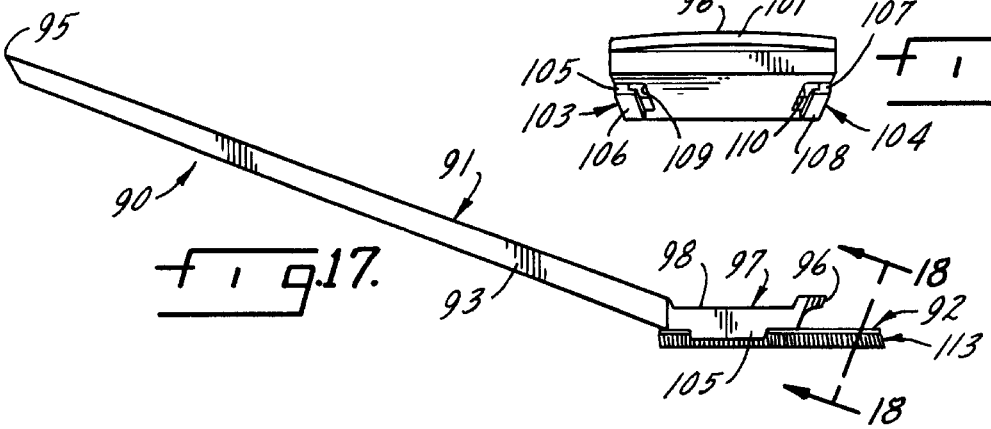
FIG. 17 is a side elevation of the third embodiment.

The head portion of the shank 93 is indicated generally at 97. The head portion is a flat plate indicated generally at 98 which lies beneath the distal end of the shank 93 by reason of downwardly and forwardly extending rear offset 99. The front end of plate 98 blends into an upwardly and forwardly extending front offset 100 which in turn terminates, at its upper edge, in a curved lip 101. L-shaped flange members, indicated generally at 103, 104, project downwardly beneath the flat plate 98 as best seen in FIG. 18. L-shaped flange 103 includes a downwardly extending portion 105 which terminates in an inwardly extending lip 106, see particularly FIG. 24. L-shaped flange 104 includes a downwardly extending portion 107, see FIG. 18, which terminates in an inwardly extending lip 108. The edges of the flat plate 98 which are aligned with the L-shaped flanges are cut away as at 109, 110. The fabric pad 92, when viewed from the top as in FIG. 21, has a roughly trapezoidal shape with a base facing to the right. The fabric pad includes a rigid, plastic backing 112 which carries a directional fabric 113 of the type above described in connection with the embodiments of FIGS. 1–15. As best seen in FIG. 23, the individual filaments 114 of the fabric are oriented in a frontward or forward direction relative to the front edge 115 of the backing 112. Cut-outs are indicated at 117 and 118, said cut-outs being located opposite the lips 106, 108 of the handle head. The distance between the long sides 119, 120 of the cut-outs 117, 118, is slightly greater than the distance between the inner edges, one of which is indicated at 121 in FIG. 24, of the lips 106, 108. As a result, when the fabric pad 92 is assembled to the handle 91, the edge portions of the fabric pad 92 at the edges of cut-outs 117, 118 are slid into the space formed between the under side of flat plate 98, and the top of lips 106, 108, as best seen in FIG. 24. It will be noted that the filaments in the area of overlap between the flat plate 98 and the lips 106, 108, will be slightly skewed, but this will not affect the operation of the louver pad. The backing 112 may be made of any suitable material so long as it is rigid, yet flexible in thin sections. As in the embodiments of FIGS. 1–11, a suitable backing material is rigid polyvinyl chloride having a thickness on the order of about 0.020 inches.

To initially assemble a fabric pad 92 to the louver pad 90 which will usually occur at the factory, a pressure is exerted on the edges of the fabric pad 92 to bow it up to an extent such that the distance between the long sides 119 and 120 of the cut-outs 117, 118, is less than the distance between the edges 121 of the lips 106, 108. In this condition, the fabric pad 92 may be worked into the position of FIGS. 16, 17, 19, 20, and 24.

To remove a used pad, as when a new color is to be applied, the reverse procedure is followed. Thus, pressure is applied to the edge portion of the fabric pad 92 to cause the distance between long sides 119 and 120 of cut-outs 117, 118 to be less than the distance between the edges 121, and the fabric pad 92 is lifted out.

A particular advantage of this third embodiment of the invention is that the angled backsides of the pads permit the user to get into multi-plane corners or trim up to the glass around windows. The acute angles of the front end of fabric pad 92 are very adapt at placing coating in small, inaccessible areas.

Benefits of the above-described fabric tools maybe summarized as 25 follows:

1. The high-density short locked-in pile (because of the woven construction) eliminates loose bristles from brushes or lint from rags that might come out because of the tacky nature of stains, varnish, bubbles, non-uniform application and brush strokes.

2. The fabric has the ability to pick up any excess stain or varnish when going over the wood a second time, thereby eliminating the need to wipe up excess coating with a rag. This eliminates the waste which occurs in the conventional method of flood-coating and wiping off the excess.

3. The first and third embodiments have a replaceable wear element which may be changed for different coatings such as color change, change from stain to varnish, and changing from solvent base to water base coatings.

4. The fabric holds considerable more coating than conventional or foam brushes.

5. The fabric meters out a more uniform discharge of coating than a brush or rag.

6. The fabric does not discharge lint like a rag, or lose brush filaments.

7. The fabric applies a more uniform coating and does not leave brush marks.

8. The fabric does not induce air into the coatings to produce undesirable bubbles as brushes and rags do.

9. The fabric performs two roles, namely, application of coating and, on subsequent passes, removal of excess coating, all in one operation.

10. The tools reduce the mess associated with brushes and rags in that they do not drip and do not require the user to get his hands into coatings when the excess is wiped up.

11. All pads and handles are solvent resistant and can be used in both solvent and water based stain, varnish, and other wood-finishing systems.

12. The large flat pad of the first embodiment allows trimming up to adjacent surfaces without getting the coating on the adjacent surface.

13. The large flat pad of the first embodiment has raised sides which prevent scraping off of the coating on subsequent passes and permits feathering during finishing strokes.

14. The pad of the third embodiment permits trimming of closely adjacent surfaces such as windows, and facilitates access to hard-to-reach places, like louver blinds, which brushes and rags either cannot achieve, or can achieve only with great difficulty.

15. The second embodiment simulates the human hand in that it bends around irregular surfaces such as spindles while providing a semi-rigid pad which will not crease sharply to discharge carried coating.

Although preferred embodiments of the invention have been illustrated and described, it will at once be apparent to those skilled in the art that variations may be made within the spirit and scope of the invention. Accordingly, it is intended that the scope of the invention be limited solely by the scope of the hereafter appended claims, when interpreted in light of the relevant prior art, and not by the foregoing description.

We claim:

1. A coating applicator comprising:

rigid handle means having a first centrally located bottom portion lying in a first plane and first flanking wing portions extending outwardly and upwardly from sides of the first centrally located bottom portion, the first central bottom portion and the first wing portions being smooth, continuous and integrally formed;

coating applicator means having a front and a rear, the coating applicator means being removably coupled to the handle means and having a second centrally located bottom portion lying in a second plane and second flanking wing portions extending outwardly and upwardly from sides of the second centrally located bottom portion such that the handle means and the coating applicator means are generally complimentarily contoured so as to closely conform and abut each other, wherein the coating applicator means comprises a continuous directional velour fabric oriented towards the front of the coating applicator means.

2. A coating applicator comprising:

a pad support;

a pad coupled to the pad support, the pad including:

a first applicating surface having a first front edge portion extending within a first plane and a rear edge opposite the first front edge; and a second applicating surface having a second front edge portion continuous with the first front edge portion and extending within a second plane, wherein the second front edge portion is tapers outwardly from the first front edge portion towards the rear edge;

a third applicating surface having a third front edge portion continuous with the first front edge portion and extending within a third plane, wherein the third front edge portion tapers outwardly from the first front edge portion towards the rear edge.

3. The applicator of claim 2 wherein the second applicating surface is inclined to the first applicating surface.

4. The applicator of claim 2 wherein at least one of the first and second applicating surfaces includes a fabric.

5. The applicator of claim 4 wherein at least one of the first and second applicating surfaces includes a high density, short pile fabric.

6. The applicator of claim 4 wherein at least one of the first and second applicating surfaces includes a directional fabric oriented towards the first and second front edge portions of the pad.

7. The applicator of claim 2 wherein the third applicating surface is inclined to the first applicating surface.

8. The applicator of claim 2 wherein the third applicating surface is flat.

9. The applicator of claim 2 wherein the second applicating surface is flat.

10. The applicator of claim 2 wherein the first applicating surface is flat.

11. The applicator of claim 2 wherein the first and second applicating surfaces include a continuous fabric extending across the first and second planes.

12. The applicator of claim 2 wherein the pad support and the pad are removably coupled to one another.

13. The applicator of claim 12 wherein the support includes:

a first support surface extending in a third plane parallel to the first plane of the first applicating surface; and a second support surface extending in a fourth plane parallel to the second plane of the second applicating surface.

14. The applicator of claim 2 wherein the pad support comprises a handle.

15. The applicator of claim 14 wherein the handle includes:

first and second finger gripping surfaces obliquely extending from the first applicating surface; and first and second sunken finger receiving cavities on opposite sides of the first and second finger gripping surfaces.

16. The applicator of claim 2 wherein the pad support includes trim guides along the first front edge portion of the pad.

17. A coating applicator pad configured for being removably coupled to a pad support, the pad comprising:

a first applicating surface having a first front edge portion extending within a first plane and a rear edge opposite the first front edge;

a second applicating surface having a second front edge portion contiguous with the first front edge portion and extending within a second plane, wherein the second front edge portion is recessed tapers outwardly from the first front edge portion towards the rear edge; and a third applicating surface having a third front edge portion continuous with the first front edge portion and extending within a third plane, wherein the third front edge portion tapers outwardly from the first front edge portion towards the rear edge.

18. The applicator of claim 17 wherein the first applicating surface, the second applicating surface and the third applicating surfaces are flat.

* * * * *